US007267593B2

(12) United States Patent
Oguma et al.

(10) Patent No.: US 7,267,593 B2
(45) Date of Patent: Sep. 11, 2007

(54) SHIFTING DEVICE FOR BOAT AND METHOD OF USING THE SAME

(75) Inventors: Takahiro Oguma, Shizuoka-ken (JP); Takashi Okuyama, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/226,963

(22) Filed: Sep. 15, 2005

(65) Prior Publication Data

US 2006/0057911 A1 Mar. 16, 2006

(30) Foreign Application Priority Data

Sep. 15, 2004 (JP) ..... 2004-268850

(51) Int. Cl.

| | |
|---|---|
| ***B60W 10/04*** | (2006.01) |
| *B63H 21/21* | (2006.01) |
| *B63H 21/22* | (2006.01) |
| *B63H 20/14* | (2006.01) |
| *B63H 23/00* | (2006.01) |

(52) U.S. Cl. ..... 440/86; 440/87; 440/84; 440/75; 440/1

(58) Field of Classification Search ..... None
See application file for complete search history.

(56) References Cited

U.S. PATENT DOCUMENTS

| | | | | |
|---|---|---|---|---|
| 6,659,815 | B2 * | 12/2003 | Motsenbocker | 440/1 |
| 6,835,109 | B2 | 12/2004 | Takada et al. | |
| 2004/0121661 | A1 * | 6/2004 | Okuyama | 440/1 |

FOREIGN PATENT DOCUMENTS

| | | |
|---|---|---|
| JP | 10-184402 | 7/1998 |

* cited by examiner

*Primary Examiner*—Jesus Sotelo
*Assistant Examiner*—Daniel V. Venne
(74) *Attorney, Agent, or Firm*—Knobbe, Martens, Olson & Bear, LLP

(57) ABSTRACT

A shift device for a boat is operated by a shift lever. Movement of the shift lever causes movement of a mechanical actuator. The device comprises means for detecting the positions of the shift lever at specified time intervals and means for obtaining by calculation an estimated time at which the shift lever will reach an operation end position based on the data from the means for detecting. Means for controlling the drive speed of the actuator also are provided. The shift device corresponds the completion of shift lever movement to the completion of shifting by timing the actuator movement to encourage shifting at the time the shift lever is anticipated to stop movement.

13 Claims, 7 Drawing Sheets

SHIFTING DEVICE FOR BOAT AND METHOD OF USING THE SAME

CROSS-REFERENCE TO RELATED APPLICATIONS

This application claims the priority benefit under 35 U.S.C. § 119(a) of Japanese Patent Application No. 2004-268850, filed Sep. 15, 2004, which is hereby incorporated by reference in its entirety.

BACKGROUND OF THE INVENTION

1. Field of the Invention

The present invention generally relates to a shift device for a boat. More particularly, the present invention relates to a shift device for a boat in which movement of a shift mechanism is operated by an actuator as controlled by a remote shift lever, and a method of using the shift device.

2. Description of the Related Art

Conventionally, a transmission of a boat includes a dog clutch that changes the modes of transmission operation among at least one speed fore, one speed aft and neutral. The dog clutch is engaged and disengaged by a lever that is rotated with a push-and-pull cable. The cable is moved via a handle gear shift.

With such a conventional configuration, the boat operator directly operates the dog clutch. For proper operation, the boat operator must use a sufficient amount of force without attempting to over-finesse the transmission. For instance, if insufficient force is applied, the gears may grind during engagement or the gears may be difficult to disengage. Further, if too much force is applied, the shifting mechanism can be damaged.

Japanese Patent Application No. 10-184402 and Japanese Patent Application No. 2004-1638 both disclose shifting mechanisms similar to those described above. The first of these describes that the rotation of the shift lever is detected with a sensor, such as a clutch switch or a throttle adjusting mechanism. The detected signals are transmitted to a control unit. At the same time, the control unit, according to the detected signals, adjusts the power from a power source and transmits it to a throttle motor or a clutch motor. Therefore, it is possible to interconnect the control unit and the outboard motor engine through a signal line.

This patent application explains, however, that the remote control box and the engine are not necessarily interconnected through the push-and-pull cable having a high rigidity. Thus, when the outboard motor is turned during steering operations, the signal line, which has a low rigidity, follows well enough the turn of the outboard motor, which results in improvement in the quality of operation.

Japanese Patent Application No. 2004-1638 discloses a shift device for an outboard motor that has an internal combustion engine mounted in the upper part and a propeller in the lower part, which propeller is driven by the engine. The outboard motor is attached to the rear part of a hull to propel the hull forward and rearward. Gear shifting is performed by sliding a shift slider through a shift rod, wherein the shift rod is driven by an actuator located within the outboard motor.

Because the shift rod is moved by the actuator, which is located within the outboard motor, the available required force is smaller in comparison to manually driving the shift rod. Thus, there is an improved sense of control. Further, the connection structure between the shift rod and the actuator can be simplified relative to a structure in which the actuator is located on the hull of the boat. Thus, such a construction features fewer parts, has a lower weight and does not take up unnecessary space in the boat hull.

In the constructions described in both of these patent applications, the operator still has a perception in performance lag because of a perceived inadequate response of the actuator to the shift lever operation. That is, when the shift lever or the remote control lever is operated quickly, there is a delay in response. In addition, when the shift lever is operated slowly, for example, from the neutral to the forward position, the gear shift actually anticipates the completion of movement of the shift lever.

Therefore, a shift device for a boat is desired that makes it possible to improve shift operation quality by improving the responsiveness of the actuator to movement of the shift lever.

SUMMARY OF THE INVENTION

Accordingly, one aspect of the present invention involves a drive assembly for a boat. The drive assembly comprises an engine. The engine powers a drive shaft. A propeller shaft is selectively coupled to the drive shaft via a shiftable transmission. The shiftable transmission is controlled by a shift device. The shift device comprises an actuator. The actuator is electrically connected to a controller. A shift lever also is connected to the controller. The controller comprises means for detecting the positions of the shift lever at specified time intervals and means for obtaining by calculation an estimated time at which the shift lever will reach an operation end position. The means for calculating uses information from the means for detecting. The drive assembly further comprises means for controlling the drive speed of the actuator such that the shift device completes a shifting operation at substantially the sane time as the shift lever reaches the operation end position.

Another aspect of the present invention involves a method of shifting a shiftable boat transmission wherein shifting is controlled by a shift lever in combination with a mechanical actuator. The shift lever is moveable from a first shift lever position to a second shift lever position and the actuator is moveable from a first actuator position to a second actuator position. The method comprises detecting a position of the shift lever at specified time intervals while the shift lever moves from the first shift lever position toward the second shift lever position; calculating an estimated time at which the shift lever will reaches the second shift lever position based upon the detected positions at multiple prior specified time intervals; and controlling the drive speed of the actuator such that the actuator arrives at the second actuator position substantially simultaneously with the shift lever reaching the second shift lever position.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

With reference now to FIGS. 1 through 7, a boat and outboard motor combination featuring a shift device that is arranged and configured in accordance with certain features, aspects and advantages of the present invention is illustrated therein.

Figure 1:
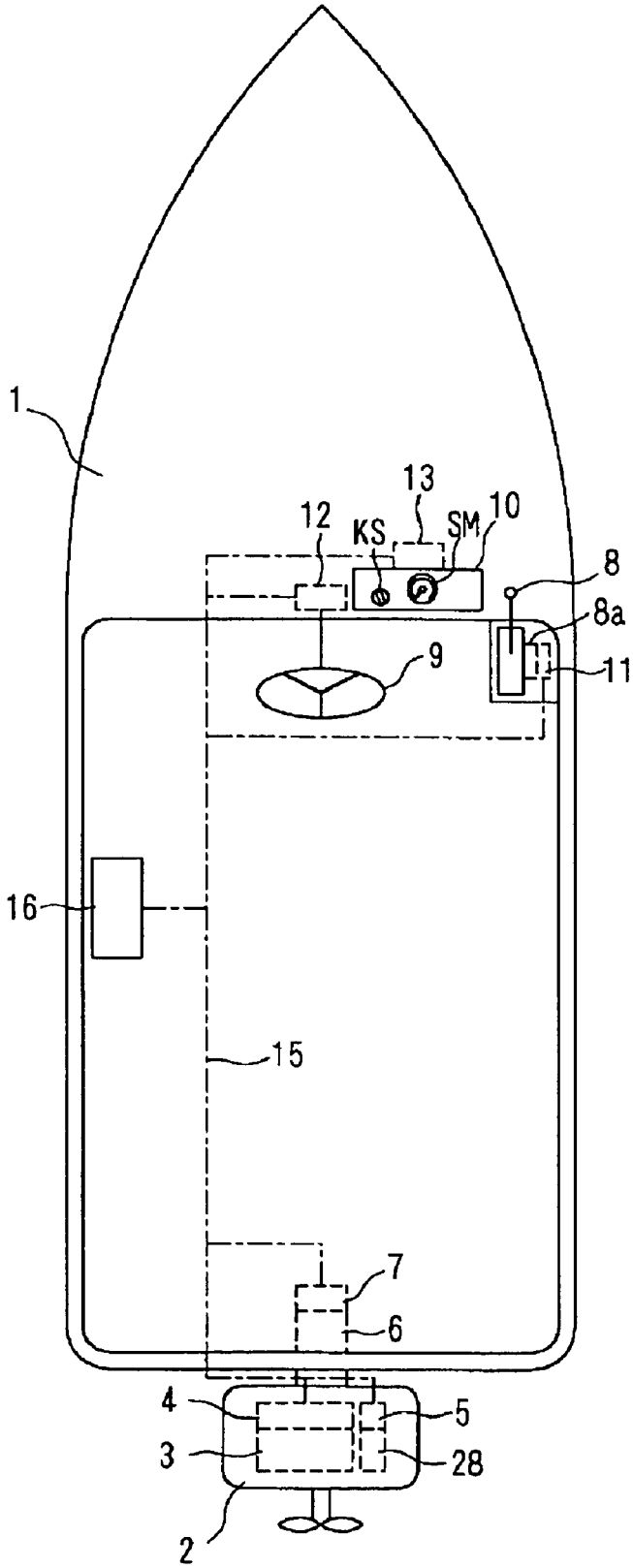
FIG. 1 schematically illustrates a hull and an outboard motor featuring a shift device that is arranged and configured in accordance with certain features, aspects and advantages of the present invention.

As shown in FIG. 1, an outboard motor 2 is attached to the stern of a hull 1. The outboard motor 2 comprises an engine control node 4. The engine control node 4 functions as an electronic control unit for electronically controlling an engine 3 that is positioned within the outboard motor 2. The outboard motor also comprises a shift control node 5 that controls a forward-reverse shift device 28 for a transmission of the outboard motor 2. To the stern bottom of the hull 1 are attached a boat speed sensor 6 that detects the boat speed and a boat speed node 7 that transmits the boat speed data detected with the boat speed sensor 6.

A shift lever 8 is located on the bow side of the illustrated hull 1. The shift lever 8 is used to remotely control the throttle opening and gear shift, which are positioned on the outboard motor 2. In the illustrated arrangement, a display unit 10 is positioned to the left front side of the shift lever 8. The illustrated display unit 10 comprises a steering device 9, a key switch KS, a boat speedometer SM, and the like. The shift lever 8 is provided with a shift node 11 for transmitting throttle opening instruction data and shift instruction data. Also the steering device 9 is provided with a steering node 12 that transmits steering angle data. Also the display unit 10 is provided with a display node 13 that transmits key switch signals and that receives the boat speed data.

Figure 2:
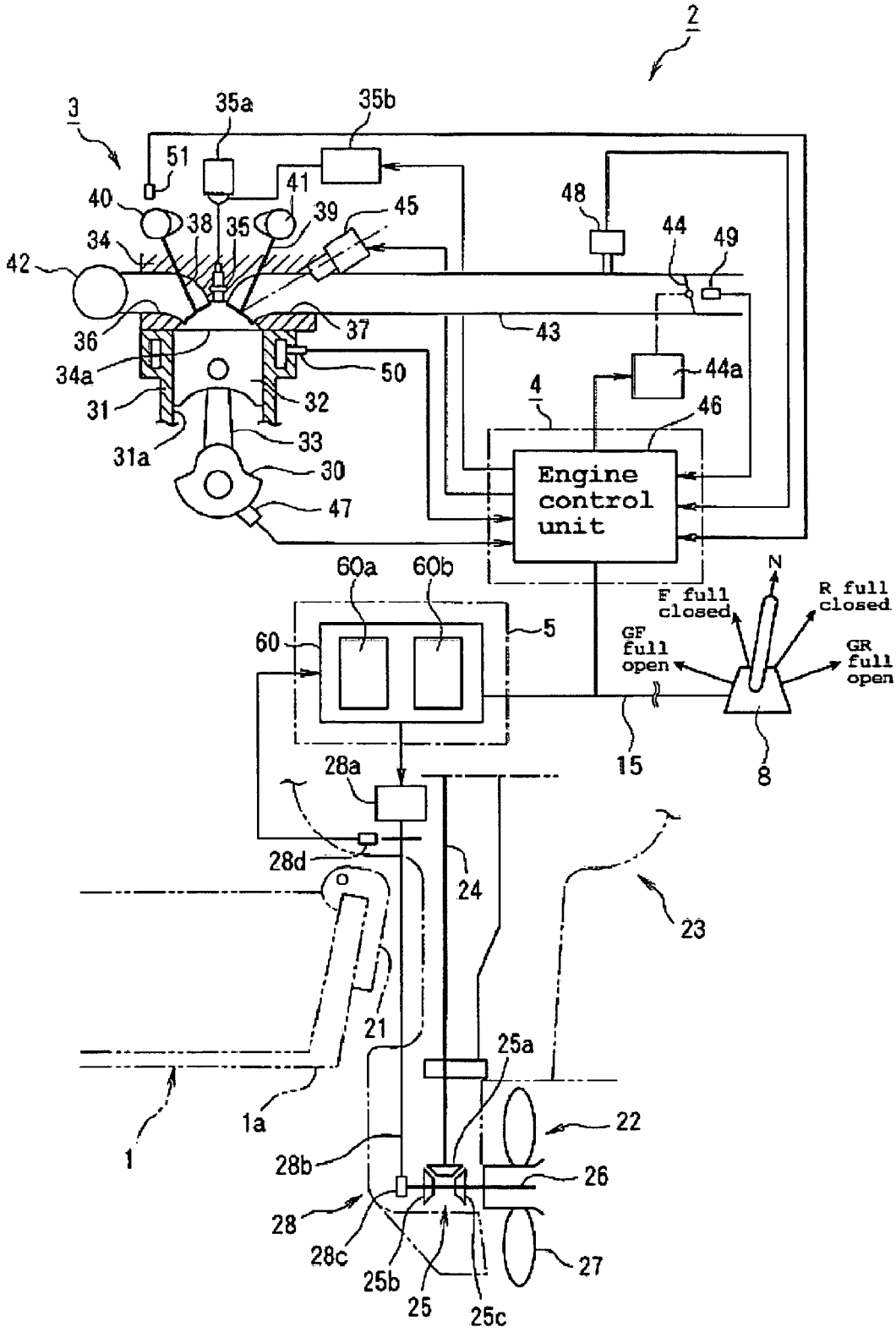
FIG. 2 schematically illustrates certain components of the arrangement of FIG. 1.

The illustrated shift lever 8, as shown in FIG. 2, is capable of choosing: a neutral position N, a forward full closed position F, a reverse full closed position R, a forward full open position GF, and a reverse full open position GR. In one configuration, the hull 1 proceeds forward at a slower rate in the forward full closed position F than in the forward full open position GF. Similarly, in one configuration, the hull 1 proceeds aft at a slower rate in the reverse full closed position R than in the reverse full open position GR. The shift lever 8 is provided with a rotary position sensor 8*a*. In one configuration, the rotary position sensor 8*a* comprises, for example but without limitation, a rotary potentiometer and an optical encoder.

The engine control node 4, the shift control node 5, the boat speed node 7, the shift node 11, the steering node 12, and the display node 13 are connected to a bus 15. In the illustrated embodiment, the bus 15 defines a transmission path that constitutes a Controller Area Network (CAN), which can be considered a kind of the local area network. To the bus 15 is connected a network control node 16 as a network control means for controlling physical addresses of the nodes 4, 5, 7, 11-13. This CAN may be configured as a wired network or a wireless network, depending upon the desired operational characteristics.

With reference to FIG. 2, the outboard motor 2 is supported at the stern 1*a* of the hull 1 through a clamp bracket 21 and may be swung up and down, and left and right. The outboard motor 2 comprises a propulsion unit 22 provided in the lower case 23 over which is mounted the engine 3. The propulsion unit 22 comprises a vertically extending drive shaft 24, a propeller shaft 26 connected to the lower end of the drive shaft 24 through a bevel gear mechanism 25, and a propeller 27 connected to the rear end of the propeller shaft 26.

With continued reference to FIG. 2, the engine 3 comprises a cylinder block 31, a piston 32 positioned within the cylinder block, a connecting rod 33 that extends through a cylinder head 34. An ignition plug 35 is positioned within the cylinder head as are an exhaust port 36 and an intake port 37. An exhaust valve 38 and an intake valve 39 are used to open and close the respective ports. A pair of camshafts 40, 41 operated the valves 38, 39. An intake pipe 34 supplies air to the end through an electronically controlled throttle valve 44. An engine revolution sensor 47, an intake pressure sensor 48, a throttle opening sensor 49, and an engine temperature sensor 50, along with other suitable sensors, are used to detect operational characteristics of the engine 3.

The bevel gear mechanism 25 comprises a drive bevel gear 25*a* attached to the drive shaft 24, and a forward bevel gear 25*b* and a reverse bevel gear 25*c* that are rotatable on the propeller shaft 26. The drive bevel gear 25*a* is constantly engaged with the forward and reverse bevel gears 25*b*, 25*c*. Thus, the propulsion unit 22 is provided with a forward-reverse shift device 28 that selects whether the forward bevel gear 25*b* or the reverse bevel gear 25*c* is coupled to the propeller shaft.

The illustrated forward-reverse shift device 28 comprises a shift rod 28*b* that extends generally vertically and that is rotated by an actuator 28*a*. The actuator 28*a* preferably comprises an electric motor but any other suitable actuator 28*a* also can be used. The actuator 28*a* of the forward-reverse shift device 28 preferably is rotary-driven.

The device 28 also comprises a dog clutch 28*c* that is connected to lower end of the shift rod 28*b*. The dog clutch 28*c* couples either the forward bevel gear 25*b* or the reverse bevel gear 25*c* to the propeller shaft. Thus, the forward-reverse shift device 28 is controlled with the dog clutch 28*c* to be in either the forward or reverse motion state in which the forward bevel gear 25*b* or the reverse bevel gear 25*c* is coupled with the propeller shaft 26 or in the neutral state in which neither of the forward and reverse bevel gears 25*b*, 25*c* is connected to the propeller shaft 26.

A shift state sensor 28*d* preferably is provided to detect the actual shifting state of the dog clutch 28*c*. In one configuration, the shift state sensor 28*d* comprises an encoder, such as an optical or magnetic encoder, for example but without limitation. The encoder detects the actual shift state by detecting the rotary angle of the shift rod 28*b*. In some configurations, the encoder can be provided on the shift rod 28*b*. Thus, in one configuration, the shift mechanism comprises the bevel gear mechanism 25 and the forward-reverse shift device 28.

The engine 3 is disposed with its crankshaft 30 being approximately vertical when running and when the outboard motor 2 is positioned as shown in FIG. 2. The lower end of the crankshaft 30 preferably is connected to the top end of the drive shaft 24. The engine 3 has a cylinder block 31 with a cylinder 31*a* bored therein. A piston 32 inserted in the cylinder 31*a* is connected through a connecting rod 33 to the crankshaft 30.

A shift control unit 60 communicates with the actuator 28*a*. The shift control unit 60 preferably comprises a microcomputer that is positioned within the shift control node 5. Other suitable configurations can be used. The shift control unit 60 comprises a calculation portion 60*a* that determines, by calculation, an estimated time at which the shift lever 8 will reach an operation end position based on data of positions obtained with a rotary position sensor 8*a* that detects the positioning of the shift lever 8 at specified time intervals while the shift lever 8 moves from an operation start position toward the operation end position. The shift control unit 60 also comprises a control portion 60*b* that controls the drive speed of the actuator 28*a* in coordination with the estimated time from the calculation portion 60*a*.

When the forward, reverse, or neutral position is chosen with the shift lever 8, position data corresponding to the chosen position is transmitted through the bus 15 to the shift control unit 60. When the position data of the shift lever 8 indicates the forward position, the dog clutch 28*c* is operated by rotating the shift rod 28*b* so that the forward bevel gear 25*b* engages with the drive bevel gear 25*a* or so that the dog clutch 28*c* causes the forward bevel gear 25*b* to be coupled to the propeller shaft. When the position data of the shift lever 8 indicates the reverse position, the dog clutch 28*c* is operated by rotating the shift rod 28*b* so that the reverse bevel gear 25*c* engages with the drive bevel gear 25*a* or so that the dog clutch 28*c* causes the reverse bevel gear 25*b* to be coupled to the propeller shaft. When the position data of the shift lever 8 indicates the neutral position, the dog clutch 28*c* is operated by rotating the shift rod 28*b* so that both the forward bevel gear 25*b* and the reverse bevel gear 25*c* stay away from the drive bevel gear 25*a* or so that the dog clutch 28*c* does not couple the forward bevel gear 25*b* or the reverse bevel gear 25*c* to the propeller shaft. Of course, the shift rod 28*b* is rotated by the actuator 28*a*. Thus, the actuator 28*a* moves the dog clutch 28*c*.

Figure 3:
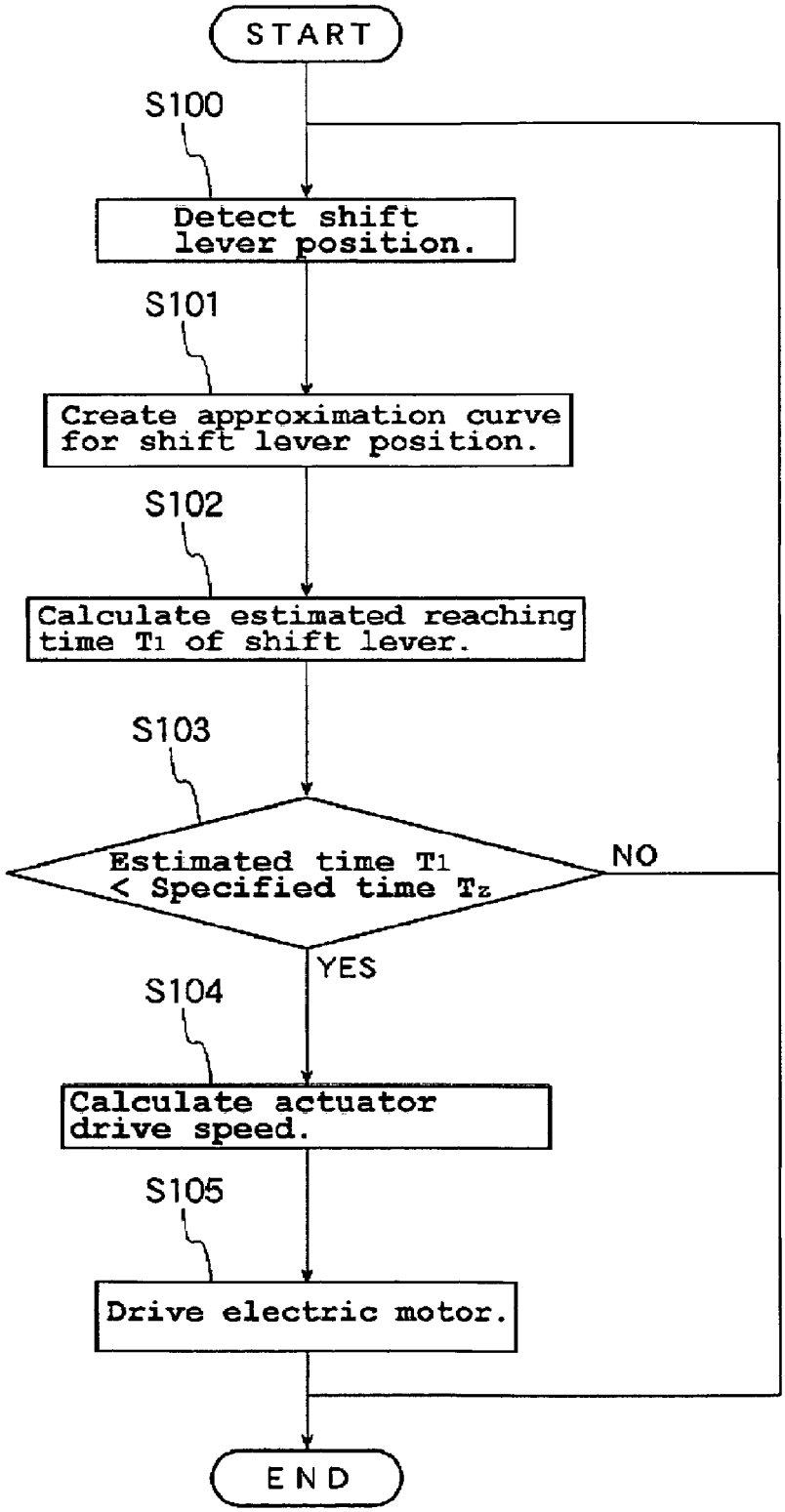
FIG. 3 is a flowchart of shift operation of the arrangement of FIG. 1.

With reference now to FIG. 3, when the shift lever 8 moves, for example, from the neutral position N to the forward full closed position F and further to the forward full open position GF, the rotary position sensor 8*a* detects positions of the moving shift lever 8 at specified time intervals, for example 0.5 ms intervals (S100 in FIG. 3). Preferably, the position of the shift lever 8 is detected at any suitable specified time interval regardless of movement of the shift lever 8. For instance, the position may be detected and the detected position may indicate that the shift lever 8 is not being moved.

Figure 4:
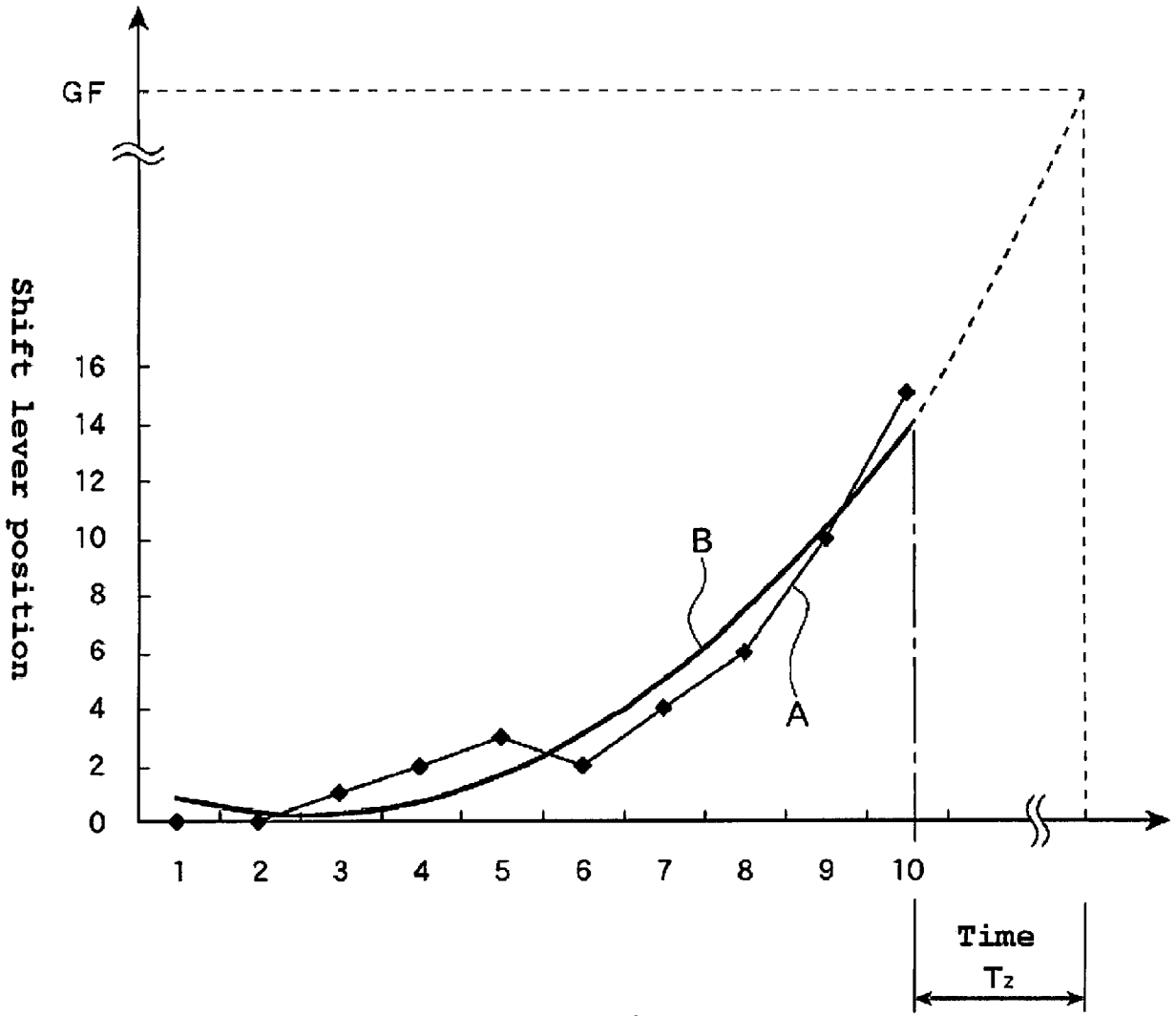
FIG. 4 is a graphical depiction of a relationship between shift lever position and passage of time relative to the arrangement of FIG. 1.

In the illustrated arrangement, the calculation portion 60*a* plots the positions of the shift lever 8 for the past 10 readings, 1st to 10th, based upon the positions detected with the rotary position sensor 8*a*. One example of such a graph is shown in FIG. 4. The plot of the actual detected positions is line A. Based on the plotted data, the calculation portion 60*a* fits a smooth polynomial approximation curve B, also shown in FIG. 4, to the points plotted along line A (S101 in FIG. 3). In the illustrated example, this approximation curve B is expressed as $$y=0.2462x^2-1.2841x+1.8833$$

From the above approximation curve B, an estimated time T1 at which the shift lever 8 reaches the forward full open position GF, the operation end position in the example, is obtained by calculation as shown with the broken line in FIG. 4 (S102 in FIG. 3). Of course, the approximation curve will be expressed by varied equations depending upon which curve fits the detected position data.

A specified time TZ from the drive start of the actuator 28*a* to the engagement completion preferably is inputted in advance into the control portion 60*b*. In FIG. 4, the time TZ happens to directly correspond to when the shift lever is predicted to reach GF and the time TZ happens to begin after the $10^{th}$ sample. During normal operation, the control portion 60*b* judges if the estimated time T1 (the time of the predicted stopping of shift lever movement) is shorter than the specified time TZ (which is the input time from start to finish of actuator movement).

If the estimated time T1 is not smaller than the specified time TZ (T1>TZ), the position of the shift lever 8 is detected again with the rotary position sensor 8*a* (See FIG. 3). In this case, the position of the shift lever 8 is detected for the 11th time with the rotary position sensor 8*a*. The calculation portion 60*a* obtains by calculation the estimated time T1 by which the shift lever 8 ends its operation, from the data for the past 10 times, 2nd through 11th.

If the estimated time T1 is smaller than the specified time TZ (T1<TZ), the calculation portion 60*a* calculates the drive speed of the actuator 28*a* (S104 in FIG. 3) so that the actuator 28*a* finishes engagement when the estimated time T1 elapses, and the drive speed of the actuator 28*a* is controlled by pulse width modulation (S105 in FIG. 3).

Figure 5:
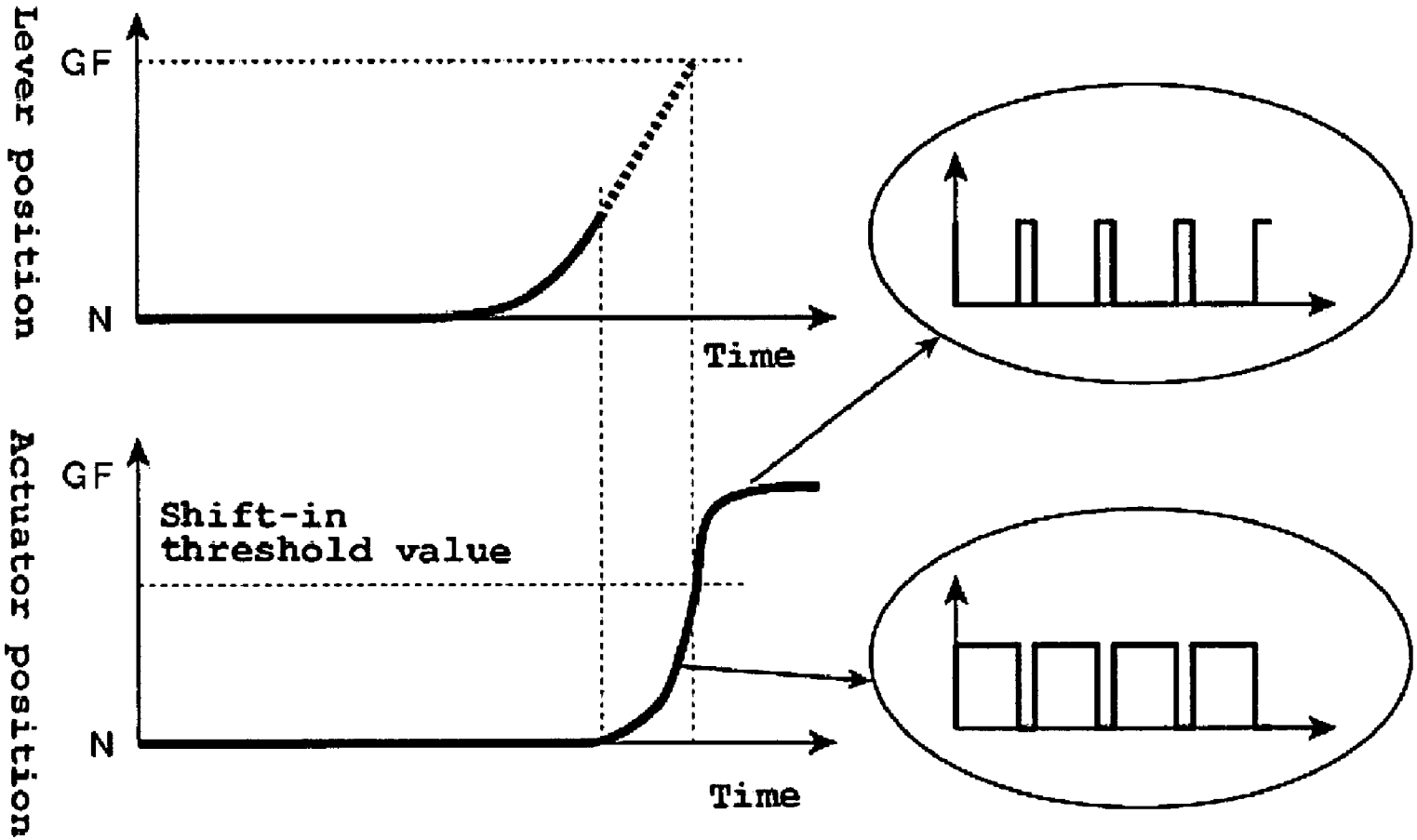
FIG. 5 shows two graphs of electric current required for a pulse width modulus control of an actuator that is operated by movement of the shift lever of the arrangement of FIG. 1.
Figure 6:
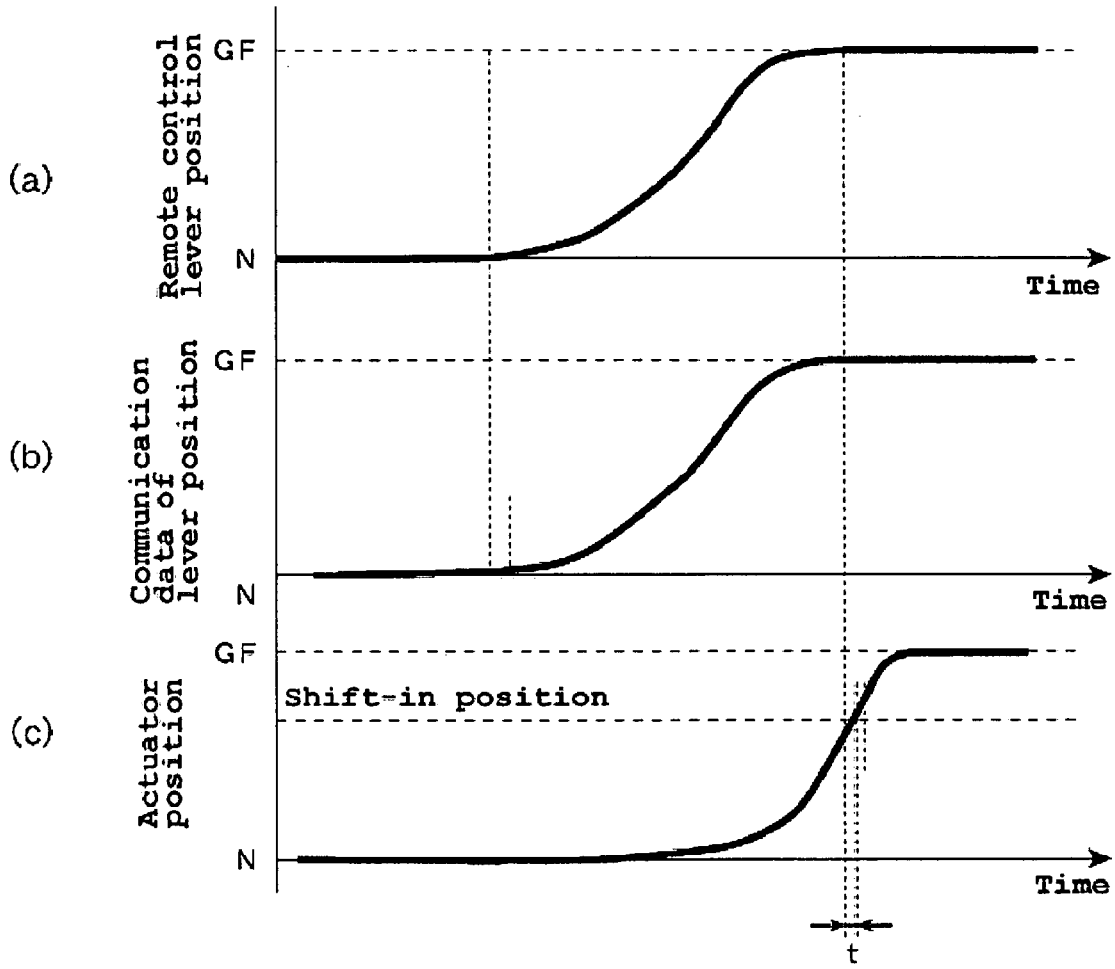
FIG. 6 shows comparison graphs between the shift lever operation and the actuator operation in the arrangement of FIG. 1 with graph (a) showing the relationship between the shift lever position and time, (b) showing the relationship between the shift lever position data and time, and (c) showing the relationship between the actuator position and time.
Figure 7:
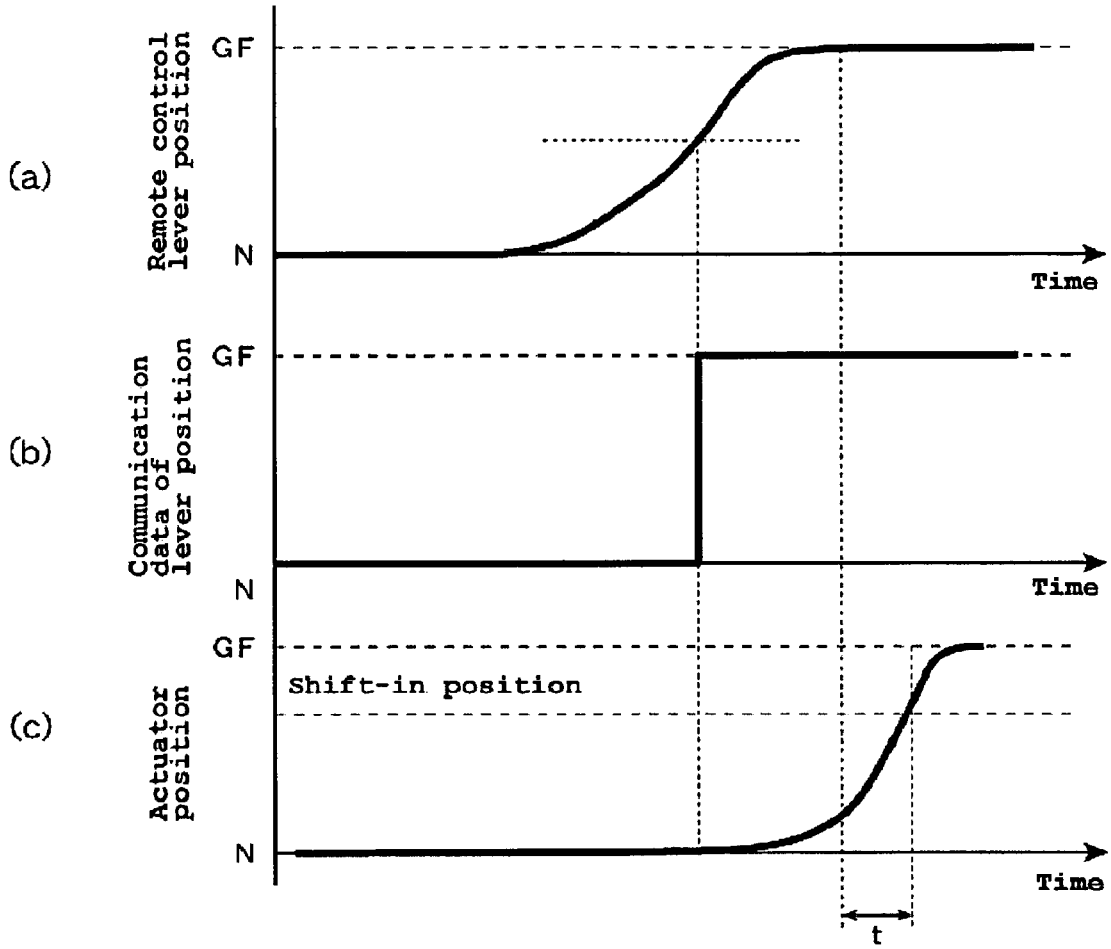
FIG. 7 shows comparison graphs similar to those of FIG. 6 using data from conventional shift devices

When the estimated time T1 is smaller than the specified time TZ (T1<TZ), as shown in FIG. 3, the actuator 28*a* immediately starts driving. As shown in FIG. 5, at the time of the drive start, the speed is increased by applying electrical current at a high duty ratio so that the actuator 28*a* finishes the shift engagement at about the same time as the shift lever 8 movement ends, thereby reducing response delay. After that, the speed is decreased by applying electric current while gradually decreasing the duty ratio. The duty ratio is set so that the shift lever stops as electric current does not flow with the duty ratio being zero at the control end time. The above control is made by the PWM (pulse width modulation). Therefore, as the drive of the actuator 28*a* is PWM-controlled, an adjustment can be made so that the actuator 28*a* completes the engagement at about the same time as the shift lever 8 stops moving. As a result, the response delay of the actuator 28*a* relative to the operation of the shift lever 8 is reduced, as will be appreciated by comparing FIG. 6 with a more conventional configuration, which is shown in FIG. 7.

As described above, the operation speed of the actuator 28*a* in the illustrated configuration is adjusted to match the operation speed of the shift lever 8. Therefore, it is possible to improve shift operation quality by reducing time lag in response of the actuator 28*a* to the operation of the shift lever 8. In other words, response delay occurring when the actuator 28*a* is operated to shift may be reduced even if the shift lever 8 is operated quickly. It is also possible to reduce the likelihood that the shift mechanism will finish its shifting operation before the shift lever operation is finished even if the shift lever 8 is operated slowly.

Because the estimated time for the shift lever 8 reaching the operation end position is obtained more accurately than heretofore, quality of shift operation is improved with an intention of allowing near simultaneous completion of movement by both the actuator 28*a* and the shift lever 8.

Further, because the shift operation is timed to end with the drive speed of the actuator 28*a* by increasing the speed of the actuator movement at the end of the range of motion, it is possible to minimizing the influence of the operation speed of the shift lever 8 upon the engagement of the dog clutch.

In some configurations, movement of the actuator is delayed until the estimated time left until movement of the shift lever stops is less than the normal time for the actuator to move to the corresponding position. In such a configuration, the rate of actuator movement is increased to compensate for the delayed start such that the movement of both the actuator and the shift lever end at more closely the same time. Thus, during rapid movements, the rate of actuator movement is increased to reduce or eliminate the sensed lag from stopping movement of the shift lever and the ending of actuator movement or engagement of the proper gears. Similarly, by delaying the start of movement, it is possible to reduce the likelihood or eliminate the likelihood of the gears being engaged prior to completion of movement of the shift lever. In one other configuration, the actuator movement is generally matched with the movement of the shift lever until the amount of time to complete actuator movement to the specified position would be less than the estimated amount of time for the shift lever to complete its movement. In other words, the operation speed of the actuator is matched to the operation speed of the shift lever.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A drive assembly for a boat, the drive assembly comprising an engine, the engine powering a drive shaft, a propeller shaft being selectively coupled to the drive shaft via a shiftable transmission, the shiftable transmission being controlled by a shift device, the shift device comprising an actuator, the actuator being electrically connected to a controller, a shift lever also connected to the controller, the controller comprising means for detecting the positions of the shift lever at specified time intervals and means for obtaining by calculation an estimated time at which the shift lever will reach an operation end position, the means for calculating using information from the means for detecting, and the drive assembly further comprising means for controlling the drive speed of the actuator such that the shift device completes a shifting operation at substantially the same time as the shift lever reaches the operation end position.

2. The drive assembly of claim 1, wherein the means for calculating is adapted to generate an approximation curve from the information provided by the means for detecting and the approximation curve is generated by a predetermined number of data points detected by the means for detecting and the approximation curve is used to estimate the time at which the shift lever will reach the operation end position.

3. The drive assembly of claim 2, wherein the control means controls the drive speed of the actuator by pulse width modulation.

4. The drive assembly of claim 3 in combination with a boat.

5. The drive assembly of claim 1, wherein the means for controlling uses pulse width modulation to control the drive speed of the actuator.

6. The drive assembly of claim 5 in combination with a boat.

7. The drive assembly of claim 1 in combination with a boat.

8. A method of shifting a shiftable boat transmission wherein shifting is controlled by a shift lever in combination with a mechanical actuator, the shift lever being moveable from a first shift lever position to a second shift lever position and the actuator being moveable from a first actuator position to a second actuator position, the method comprising detecting a position of the shift lever at specified time intervals while the shift lever moves from the first shift lever position toward the second shift lever position; calculating an estimated time at which the shift lever will reach the second shift lever position based upon the detected positions at multiple prior specified time intervals; and controlling the drive speed of the actuator such that the actuator arrives at the second actuator position substantially simultaneously with the shift lever reaching the second shift lever position.

9. The method of claim 8, wherein the drive speed of the actuator is increased just prior to the second actuator position being reached.

10. The method of claim 8, wherein calculating the estimated time comprises plotting a curve reflecting data obtained by detecting the shift lever position at specified time intervals.

11. The method of claim 10, wherein calculating the estimated time comprises extrapolating the plotted curve such that the estimated time is obtained where the second shift lever intersects the plotted curve.

12. The method of claim 8, wherein the actuator does not begin moving until the estimated time is less than a preset time for the actuator to move from the first actuator position to the second actuator position.

13. The method of claim 12, wherein the second actuator position corresponds to a position at which gears will begin to drive a propeller shaft connected with a transmission.

* * * * *